US008417133B2

(12) United States Patent
Ahn et al.

(10) Patent No.: US 8,417,133 B2
(45) Date of Patent: Apr. 9, 2013

(54) APPARATUS AND METHOD FOR SUPPLYING CHARGE VOLTAGE TO ORGANIC PHOTOCONDUCTOR DRUM

(75) Inventors: Myung-kook Ahn, Hwaseong-si (KR); Sang-don Lee, Gwacheon-si (KR); Sung-min Park, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 293 days.

(21) Appl. No.: 12/923,225

(22) Filed: Sep. 9, 2010

(65) Prior Publication Data

US 2011/0135328 A1 Jun. 9, 2011

(30) Foreign Application Priority Data

Dec. 8, 2009 (KR) ..... 10-2009-012412

(51) Int. Cl.
*G03G 15/02* (2006.01)

(52) U.S. Cl.
USPC ..... 399/50

(58) Field of Classification Search ..... 399/26, 399/44, 50
See application file for complete search history.

(56) References Cited

U.S. PATENT DOCUMENTS

| | | | | |
|---|---|---|---|---|
| 5,852,756 | A * | 12/1998 | Teranishi et al. | 399/44 |
| 7,027,747 | B2 * | 4/2006 | Iwasaki et al. | 399/44 |
| 7,149,447 | B2 * | 12/2006 | Haga | 399/50 |
| 7,764,888 | B2 * | 7/2010 | Hagiwara et al. | 399/44 |
| 7,941,062 | B2 * | 5/2011 | Yonekubo | 399/44 |
| 7,962,055 | B2 * | 6/2011 | Takuma et al. | 399/44 |

FOREIGN PATENT DOCUMENTS

| | | | |
|---|---|---|---|
| JP | 11-015340 | | 1/1999 |
| JP | 11-305608 | | 11/1999 |
| JP | 2002072593 | A * | 3/2002 |
| JP | 2006011173 | A * | 1/2006 |
| JP | 2006126640 | A * | 5/2006 |

* cited by examiner

*Primary Examiner* — Robert Beatty
(74) *Attorney, Agent, or Firm* — Staas & Halsey LLP

(57) ABSTRACT

Provided is an apparatus and method for supplying a charge voltage to an organic photoconductor (OPC) drum. The apparatus includes a storage unit for storing first service life information of the OPC drum according to a first supplying method, and second service life information of the OPC drum according to a second supplying method, a sensor unit for measuring information about conditions surrounding the apparatus, a control unit for selecting one of the first and second supplying methods according to the measured information and determining a charge voltage corresponding to the service life information according to the selected method, and a voltage supplying unit using the selected method to supply the determined charge voltage to the OPC drum.

19 Claims, 3 Drawing Sheets

| DC SUPPLYING METHOD | AC/DC SUPPLYING METHOD |
|---|---|
| FIRST SERVICE LIFE (600K [TIMES]) | SECOND SERVICE LIFE (400K [TIMES]) |
| 350K [TIMES] | 240K [TIMES] |

FIG. 3

| DC SUPPLYING METHOD | | AC/DC SUPPLYING METHOD | |
|---|---|---|---|
| FIRST SERVICE LIFE | FIRST CHARGE VOLTAGE ($V_{DC}$) | SECOND SERVICE LIFE | SECOND CHARGE VOLTAGE ($V_{DC}$, $V_{PP}$) |
| 600K [TIMES] | 7000 | 400K [TIMES] | $V_{DC}$ : 6000<br>$V_{PP}$ : 5000 |
| 500K ~ 600K [TIMES] | 6900 | 400K ~ 350K [TIMES] | $V_{DC}$ : 5700<br>$V_{PP}$ : 4500 |
| 500K ~ 550K [TIMES] | 6850 | 350K ~ 300K [TIMES] | $V_{DC}$ : 5800<br>$V_{PP}$ : 4400 |
| 450K ~ 500K [TIMES] | 6700 | 300K ~ 250K [TIMES] | $V_{DC}$ : 5500<br>$V_{PP}$ : 4300 |
| 400K ~ 450K [TIMES] | 6650 | 250K ~ 200K [TIMES] | $V_{DC}$ : 5200<br>$V_{PP}$ : 4400 |
| 350K ~ 400K [TIMES] | 6530 | 200K ~ 150K [TIMES] | $V_{DC}$ : 5150<br>$V_{PP}$ : 4200 |
| 300K ~ 350K [TIMES] | 6450 | 150K ~ 100K [TIMES] | $V_{DC}$ : 5000<br>$V_{PP}$ : 4100 |
| 250K ~ 300K [TIMES] | 6400 | 100K ~ 50K [TIMES] | $V_{DC}$ : 4900<br>$V_{PP}$ : 4000 |
| 200K ~ 250K [TIMES] | 6300 | 50K [TIMES] OR LESS | $V_{DC}$ : 4700<br>$V_{PP}$ : 3900 |
| 150K ~ 200K [TIMES] | 6250 | | |
| 100K ~ 150K [TIMES] | 6200 | | |
| 50K ~ 100K [TIMES] | 6250 | | |
| 50K [TIMES] OR LESS | 6300 | | |

APPARATUS AND METHOD FOR SUPPLYING CHARGE VOLTAGE TO ORGANIC PHOTOCONDUCTOR DRUM

CROSS-REFERENCE TO RELATED APPLICATIONS

This application claims the benefit of Korean Patent Application No. 10-2009-0121412, filed on Dec. 8, 2009, in the Korean Intellectual Property Office, the disclosure of which is incorporated herein in its entirety by reference.

BACKGROUND

1. Field

The present general inventive concept relates to an apparatus and a method for supplying a charge voltage to an organic photoconductor (OPC) drum.

2. Description of the Related Art

Image forming apparatuses repetitively perform a sequence of charging, exposing, developing, transferring, and fusing operations to form an image on paper (or printing medium). In the transferring operation, high voltage is supplied to an organic photoconductor (OPC) drum to form a predetermined charge voltage on a surface of an OPC. To supply a charge voltage to an OPC drum, a method of supplying a direct current (DC) voltage is used, or a method of supplying a DC obtained by combining alternating current (AC) voltages is used. However, since using just one of the two methods is inadequate for the conditions surrounding an image forming apparatus, charge efficiency may be degraded, and the service life of an OPC drum may be reduced.

SUMMARY

The present general inventive concept provides an apparatus and a method for supplying a charge voltage to an organic photoconductor (OPC) drum in a manner adequate for conditions surrounding the apparatus.

According to an embodiment, there is provided an apparatus for supplying a charge voltage to an organic photoconductor (OPC) drum, the apparatus including: a storage unit to store first service life information of the OPC drum according to a first supplying method, and second service life information of the OPC drum according to a second supplying method; a sensor unit to measure information about conditions surrounding the apparatus; a control unit to select one of the first and second supplying methods according to the measured information and determining a charge voltage corresponding to the service life information according to the selected method; and a voltage supplying unit to use the selected method to supply the determined charge voltage to the OPC drum.

According to another embodiment, there is provided a method of supplying a charge voltage to an organic photoconductor (OPC) drum, the method including: measuring information about conditions surrounding an apparatus; selecting one of a first supplying method and a second supplying method to supply a charge voltage to the OPC drum according to the measured information; determining a charge voltage corresponding to a service life information according to the selected method; and using the selected method to supply the determined charge voltage to the OPC drum.

According to another embodiment, there is provided a computer-readable recording medium in which a program for executing the method of supplying a charge voltage to an OPC drum in a computer is recorded.

BRIEF DESCRIPTION OF THE DRAWINGS

The above and/or other features and advantages of the embodiment will become more apparent by describing in detail exemplary embodiments thereof with reference to the attached drawings in which:

FIG. 3 is a table illustrating charge voltages corresponding to service life information, according to an embodiment.

DETAILED DESCRIPTION

An embodiment or embodiments will now be described more fully with reference to the accompanying drawings, in which exemplary embodiments.

Figures 1, 2:
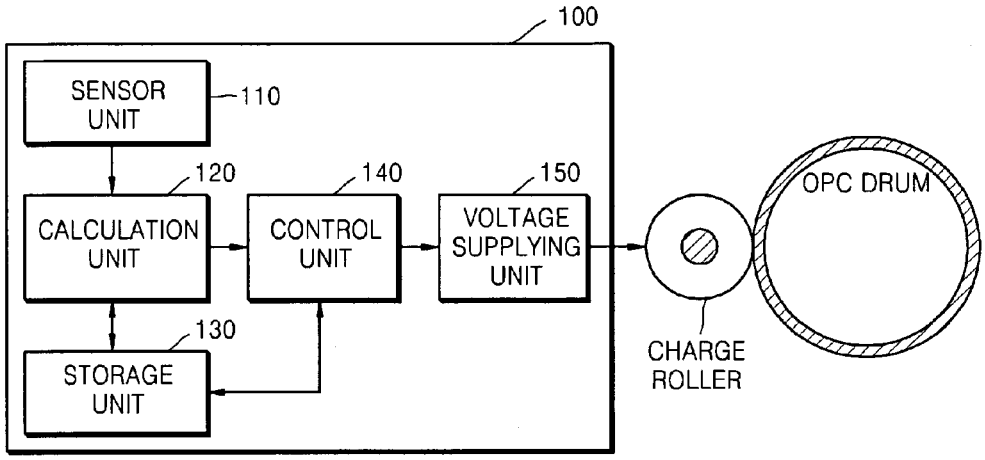
FIG. 1 is a schematic view illustrating an apparatus for supplying a charge voltage to an organic photoconductor (OPC) drum according to an embodiment.
FIG. 2 is a table illustrating first service life information of an OPC drum according to a first supplying method, and a second service life information of an OPC drum according to a second supplying method, according to an embodiment.

FIG. 1 is a schematic view illustrating an apparatus 100 for supplying a charge voltage to an organic photoconductor (OPC) drum according to an embodiment. The apparatus 100 includes a sensor unit 110, a calculation unit 120, a storage unit 130, a control unit 140, and a voltage supplying unit 150.

The sensor unit 110 measures information about conditions surrounding the apparatus 100. In an embodiment, the conditions surrounding the apparatus 100 may include temperature and/or humidity. Thus, the sensor unit 110 measures the information about temperature and/or humidity surrounding the apparatus 100.

The calculation unit 120 calculates absolute humidity on the basis of temperature and humidity measured by the sensor unit 110. We could know the amount of saturated water vapor in a specific temperature. Also, the calculation unit 120 calculates the amount of water vapor in the specific temperature from the amount of saturated water vapor and a relative humidity. Thus, the calculation unit 120 calculates the absolute humidity from the temperature and the relative humidity. Since humidity measured by the sensor unit 110 is relative humidity, which is affected by temperature, the calculation unit 120 calculates absolute humidity, which is not affected by temperature.

The storage unit 130 stores first service life information of the OPC drum according to a first supplying method, and second service life information of the OPC drum according to a second supplying method. The storage unit 130 also stores values of first charge voltages corresponding to the first service life information, and values of second charge voltages corresponding to the second service life information. In the present embodiment, the first supplying method or the second supplying method is used to supply a charge voltage to the OPC drum. In the first supplying method, a direct current (DC) voltage is applied to a charge roller contacting the OPC drum, to supply a charge voltage to the OPC drum. In the second supplying method, a DC voltage obtained by combining alternating current (AC) voltages is applied to the charge roller to supply a charge voltage to the OPC drum.

A layer for forming a charge voltage is formed on a surface of the OPC drum. The layer for forming a charge voltage is worn by rotation of the OPC drum, and thus the thickness of the layer is reduced. In this case, when the thickness of the layer is less than a predetermined thickness, it is difficult to form a predetermined charge voltage on the OPC drum. Therefore, the service life of the OPC drum is determined by whether the thickness of the OPC drum is greater than a predetermined thickness. As such, the service life of an OPC drum is measurable. In addition, the service life of an OPC drum provided with a DC voltage is different from that of an OPC drum provided with a DC voltage obtained by combining AC voltages because wear rates of layers formed on the OPC drums are different. In this case, the wear rate of the layer of the OPC drum provided with a DC voltage obtained by combining AC voltages is higher than that of the layer of the OPC drum provided with a DC voltage since the AC voltages more affect the wear of the layer than the DC voltage.

FIG. 2 is a table illustrating the first service life information of an OPC drum according to the first supplying method, and the second service life information of an OPC drum according to the second supplying method, according to an embodiment. Referring to FIG. 2, the OPC drum, which can rotate 600K [times] according to a DC supplying method as the first supplying method, has a service life information of 350K [times], and the OPC drum, which can rotate 400K [times] according to an AC/DC supplying method as the second supplying method, has a service life information of 240K [times]. Thus, when the first supplying method is used, the number of rotations of the OPC drum can be increased by 250K [times]. When the second supplying method is used, the number of rotations of the OPC drum can be increased by 160K [times]. As such, the service life information of the OPC drum is determined according to whether the first supplying method is used or the second supplying method is used. The service life information of the OPC drum is represented by the number of rotations of the OPC drum in the present embodiment, but the present general inventive concept is not limited thereto. For example, the service life information of an OPC drum may be represented by the driving time of the OPC drum or the number of pages output from an image forming apparatus. Furthermore, the service life information of an OPC drum may be represented by the number of rotations obtained by subtracting an actual number of rotations from a rated number of rotations of the OPC drum. The first service life information of the OPC drum according to the first supplying method, and the second service life information of the OPC drum according to the second supplying method vary as the OPC drum is rotated. Thus, the first service life information and the second service life information of the OPC drum, which are stored in the storage unit 130, are updated whenever the OPC drum is rotated.

FIG. 3 is a table illustrating charge voltages corresponding to service life information, according to an embodiment. Referring to FIG. 3, the first service life information of an OPC drum according to the DC supplying method corresponds to the first charge voltages to be supplied to the OPC drum, and the second service life information of an OPC drum according to the AC/DC supplying method corresponds to the second charge voltages to be supplied to the OPC drum according to the AC/DC supplying method. The charge voltages to be supplied to the OPC drums vary according to the resistances of charge rollers and the thicknesses of layers formed on the OPC drums. Thus, the charge voltages corresponding to the service life information of the OPC drums are measurable. In the present embodiment, the charge voltages correspond to the service life information having predetermined ranges, but the present general inventive concept is not limited thereto. Thus, charge voltages may correspond to constant service life information having predetermined values.

Referring again to FIG. 1, the storage unit 130 stores the first service life information and the second service life information, as illustrated in FIG. 2, and stores the values of the first charge voltages corresponding to the first service life information, and the values of the second charge voltages corresponding to the second service life information, as illustrated in FIG. 3.

Based on the information measured by the sensor unit 110, the control unit 140 selects one of the first and second supplying methods as a method of supplying a charge voltage to the OPC drum, and determines a charge voltage corresponding to the service life information according to the selected method. When a DC voltage supplying method is used, the service life of an OPC drum is increased, but charge performance is degraded. In addition, when a method of supplying a DC voltage obtained by combining AC voltages is used, the service life of an OPC drum is decreased, but charge performance is improved. When humidity in air increases, it is difficult to form a uniform charge voltage on an OPC drum. In this case, an output image has micro-jitters caused by uneven charging. Such micro-jitters are affected by absolute humidity, and quickly increase when absolute humidity reaches a predetermined value or greater. Thus, in the present embodiment, when absolute humidity surrounding the device 100 is greater than a value where the occurrence of micro-jitters is quickly increased, the method of supplying a DC voltage obtained by combining AC voltages is used since the method has excellent charge performance. On the contrary, when the absolute humidity surrounding the apparatus 100 is less than the value where the occurrence of micro-jitters is quickly decreased, the direct voltage supplying method is used to increase the service life of the OPC drum. According to values measured according to the present embodiment, the occurrence of micro-jitters is quickly increased when the absolute humidity is about 10 $g/cm^3$ or greater. Thus, in the present embodiment, 10 $g/cm^3$ is selected as a reference value for selecting a charge voltage supplying method.

The control unit 140 compares the absolute humidity surrounding the apparatus 100 with a preset absolute humidity, and selects a charge voltage supplying method according to a comparison result. When the absolute humidity calculated by the calculation unit 120 is less than about 10 $g/cm^3$, which is the preset value of absolute humidity, the control unit 140 selects the direct voltage supplying method. On the contrary, when the absolute humidity is greater than about 10 $g/cm^3$, the control unit 140 selects the method of supplying a DC voltage obtained by combining AC voltages.

The control unit 140 selects a charge voltage to be supplied to the OPC drum according to the service life information of the OPC drum corresponding to the selected charge voltage supplying method. From charge voltages corresponding to the service life information stored in the storage unit 130, the control unit 140 selects a charge voltage to be supplied to the OPC drum. According to the present embodiment, the storage unit 130 stores the first service life information according to the first supplying method, and the second service life information according to the second supplying method, as illustrated in FIG. 2, and stores the values of the first charge voltages corresponding to the first service life information, and the values of the second charge voltages corresponding to the second service life information, as illustrated in FIG. 3. Thus, the control unit 140 extracts the service life information according to any one selected from the first and second supplying methods of FIG. 2, and extracts the charge voltage value, corresponding to the extracted service life information, from the table of FIG. 3, so as to determine a charge voltage to be supplied to the OPC drum. For example, when absolute humidity calculated by the calculation unit 120 is about 20 g/cm$^3$, which is greater than 10 g/cm$^3$, the control unit 140 selects the second supplying method. The service life of the OPC drum according to the second supplying method is 240K [times], as illustrated in FIG. 2. In this case, the charge voltages corresponding to 240K [times] are 5200 [$V_{DC}$] and 4400 [$V_{PP}$], as illustrated in FIG. 3. Thus, the control unit 140 selects the second supplying method as a method of supplying a charge voltage to the OPC drum, and selects the charge voltages of 5200 [$V_{DC}$] and 4400 [$V_{PP}$] as charge voltages to be supplied to the OPC drum.

The voltage supplying unit 150 uses the voltage supplying method selected by the control unit 140 to supply the charge voltage determined by the control unit 140 to the OPC drum. Then, a printing process is performed.

When the printing process is completed, the OPC drum has new service life information due to the rotation of the OPC drum, and the calculation unit 120 calculates the new service life information of the OPC drum. According to the present embodiment, the new service life information of the OPC drum may be calculated using the formulas below. In more detail, when a charge voltage is supplied to the OPC drum using the first supplying method, new first service life information of the OPC drum may be calculated using Formula 1. When a charge voltage is supplied to the OPC drum using the first supplying method, new second service life information of the OPC drum may be calculated using Formula 2. When a charge voltage is supplied to the OPC drum using the second supplying method, new first service life information of the OPC drum may be calculated using Formula 3. When a charge voltage is supplied to the OPC drum using the second supplying method, new second service life information of the OPC drum may be calculated using Formula 4.

$$\text{New } L1 = L1 + L1\text{add} \quad \text{[Formula 1]}$$

$$\text{New } L2 = L2 + L1\text{add} \times R1 \quad \text{[Formula 2]}$$

$$\text{New } L1 = L1 + L2\text{add} \times R2 \quad \text{[Formula 3]}$$

$$\text{New } L2 = L2 + L2\text{add} \quad \text{[Formula 4]}$$

where, when a charge voltage is supplied to the OPC drum using the first supplying method, the new first service life information of the OPC drum is denoted by New L1, the first service life information of the OPC drum, which is stored in a memory, is denoted by L1, and a variation amount of the first service life information is denoted by L1 add; and when a charge voltage is supplied to the OPC drum using the second supplying method, the new second service life information of the OPC drum is denoted by New L2, the second service life information of the OPC drum, which is stored in the memory, is denoted by L2, and a variation amount of the second service life information is denoted by L2add; a first correction coefficient for converting the variation amount of the first service life information according to the first supplying method into the variation amount of the second service life information is denoted by R1; and a second correction coefficient for converting the variation amount of the second service life information according to the second supplying method into the variation amount of the first service life is denoted by R2.

According to Formulas 1 through 4, the manner in which the calculation unit 120 calculates new first service life information and new second service life information varies according to the methods of supplying a charge voltage. In addition, service life information according to the method that is different from a used voltage supplying method is calculated using a correction coefficient. This is because service life information varies according to whether the first supplying method is used or the second supplying method is used. The first and second correction coefficients may be determined using a thickness reduction rate of the layer formed on the OPC drum when the first or second supplying method is used. For example, the thickness reduction rate of the layer is 0.2 when the first supplying method is used, and the thickness reduction rate of the layer is 0.5 when the second supplying method is used. In this case, the first correction coefficient (R1) is 0.2/0.5, and the second correction coefficient (R2) is 0.5/0.2.

Referring again to FIG. 1, the control unit 140 uses the new first and second service life information calculated by the calculation unit 120 to update the first and second service life information stored in the storage unit 130. Therefore, updated first and second service life information is stored in the storage unit 130.

Figure 4:
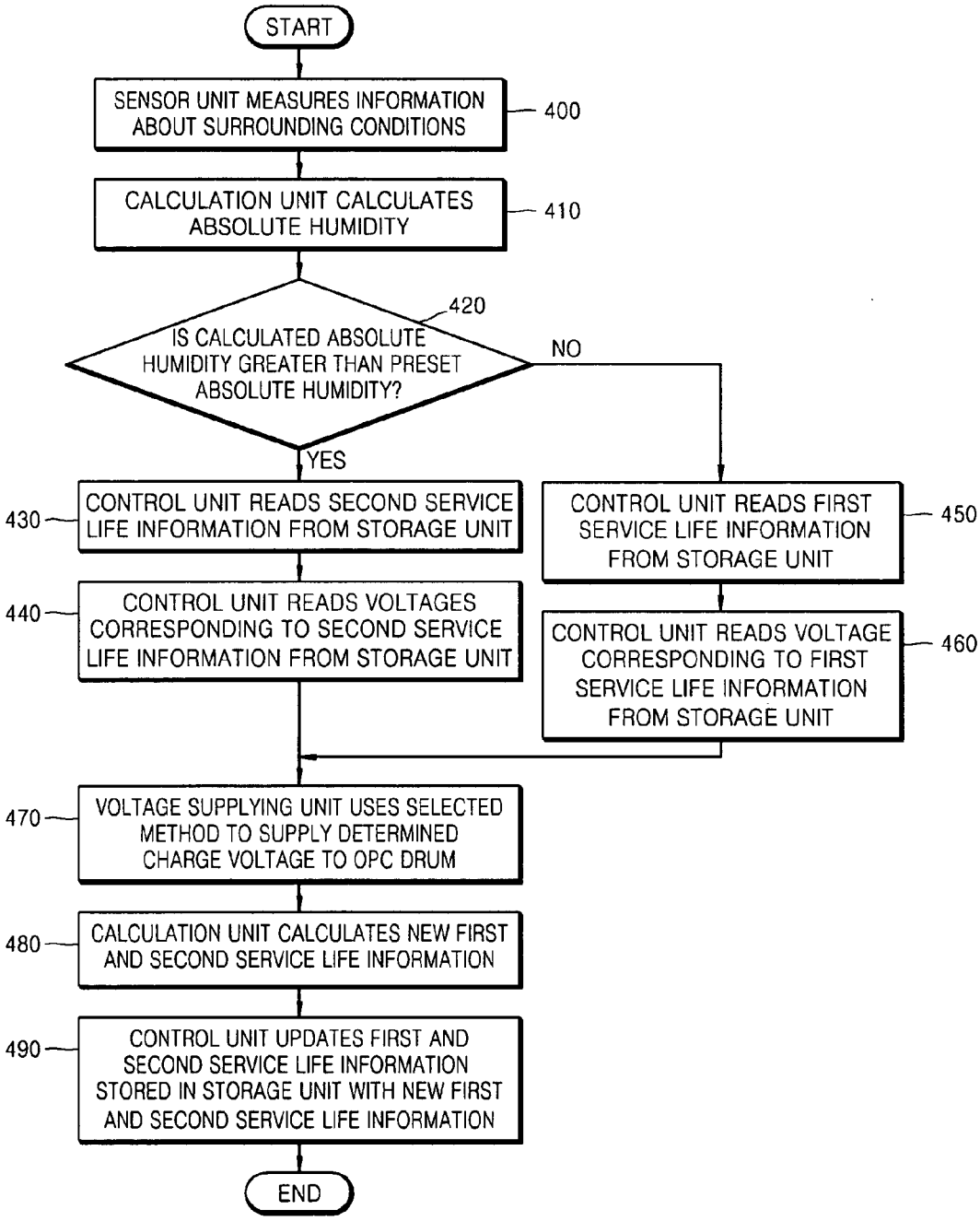
FIG. 4 is a flowchart illustrating a method of supplying a charge voltage to an OPC drum, according to an embodiment.

FIG. 4 is a flowchart illustrating a method of supplying a charge voltage to an OPC drum, according to an embodiment. Hereinafter, the method of FIG. 4 will now be described with reference to FIGS. 1 through 3.

In operation 400, a sensor unit according to the present embodiment measures information about surrounding conditions. In more detail, the sensor unit measures temperature and humidity surrounding an apparatus.

In operation 410, a calculation unit calculates absolute humidity based on the temperature and humidity measured by the sensor unit.

In operation 420, a control unit compares the calculated absolute humidity with a preset absolute humidity. The preset absolute humidity is about 10 g/cm$^3$ in the present embodiment, but the present general inventive concept is not limited thereto. Micro-jitters causing a defective image quickly increase at the preset absolute humidity. If the calculated absolute humidity is greater than the preset absolute humidity, operation 430 is performed. Otherwise, if the calculated absolute humidity is less than or equal to the preset absolute humidity, operation 450 is performed.

In operation 430, the control unit reads second service life information from a storage unit. The control unit selects the AC/DC supplying method, which is the second supplying method, as a method of supplying a charge voltage to an OPC drum, when the calculated absolute humidity is greater than the preset absolute humidity. Thus, the control unit reads the second service life information according to the AC/DC supplying method, from the storage unit. The second service life information of 240K [times], as illustrated in FIG. 2, is read from the storage unit by the control unit.

In operation 440, the control unit reads the values of voltages corresponding to the second service life information, from the storage unit. As illustrated in FIG. 3, the values of the voltages of 5200 [$V_{DC}$] and 4400 [$V_{PP}$], which correspond to the second service life information of 240K [times], are read. The control unit selects the voltages of 5200 [$V_{DC}$] and 4400 [$V_{PP}$] as second charge voltages to be supplied to the OPC drum.

In operation 450, the control unit reads first service life information from the storage unit. The control unit selects the DC supplying method, which is the first supplying method, as a method of supplying a charge voltage to an OPC drum, when the calculated absolute humidity is less than the preset absolute humidity. Thus, the control unit reads the first service life information according to the DC supplying method from the storage unit. The first service life information of 350K [times], as illustrated in FIG. 2, is read from the storage unit by the control unit.

In operation 460, the control unit reads the value of a voltage corresponding to the first service life information, from the storage unit. As illustrated in FIG. 3, the value of the voltage of 6530 [$V_{DC}$], which corresponds to the first service life information of 350K [times], is read. The control unit selects the voltage of 6530 [$V_{DC}$] as a first charge voltage to be supplied to the OPC drum.

In operation 470, a voltage supplying unit uses the selected method to supply the selected charge voltage to the OPC drum. According to the present embodiment, the second supplying method is used to supply the second charge voltages of 5200 [$V_{DC}$] and 4400 [$V_{PP}$] to the OPC drum, or the first supplying method is used to supply the first charge voltage of 6530 [$V_{DC}$] to the OPC drum.

In operation 480, the calculation unit calculates new first service life information and new second service life information. The calculation unit may use Formulas 1 through 4 to calculate the new first and second service life information. According to Formulas 1 through 4, the first and second service life information is stored in the storage unit, and the used voltage supplying method may be used by the calculation unit to calculate the new first and second service life information.

In operation 490, the control unit updates the first and second service life information stored in the storage unit with the new first and second service life information. Therefore, new first and second service life information is stored in the storage unit.

The embodiments may be written as computer programs and may be implemented in general-use digital computers that execute the programs using computer-readable recording media. The information used in the aforementioned embodiments may be recorded in computer-readable recording media through various members. Examples of the computer-readable recording medium include magnetic storage media (e.g., read-only memory (ROM), floppy disks, and hard disks) and optical reading media (e.g., CD-ROMs and digital video disks (DVDs)).

While the embodiment has been particularly shown and described with reference to exemplary embodiments thereof, it will be understood by those of ordinary skill in the art that various changes in form and details may be made therein without departing from the spirit and scope of the embodiment as defined by the following claims.

What is claimed is:

1. An image forming apparatus for supplying a charge voltage to an image bearing member, the apparatus comprising:

a storage unit to store first service life information of the image bearing member according to a first supplying method, and second service life information of the image bearing member according to a second supplying method;

a sensor unit to measure information about conditions surrounding the apparatus;

a control unit to select one of the first and second supplying methods according to the measured information; and a voltage supplying unit to supply the determined charge voltage to the image bearing member using the selected method, wherein the first supplying method and the second supplying method are different from each other in type of voltage supplied to the image bearing member.

2. The apparatus of claim 1, wherein the control storage unit further comprises to determine the charge voltage corresponding to the service life information according to the selected method.

3. The apparatus of claim 1, wherein the storage unit stores a first charge voltage value corresponding to the first service life information, and a second charge voltage value corresponding to the second service life information.

4. The apparatus of claim 1, wherein the first supplying method is a method of supplying a direct current (DC) voltage, and the second supplying method is a method of supplying a DC voltage obtained by combining alternating current (AC) voltages.

5. The apparatus of claim 1, wherein the service life information comprises one of the number of rotations of the image bearing member, the number of pages output by the image bearing member, and a driving time of the image bearing member.

6. The apparatus of claim 1, wherein the information about the conditions surrounding the apparatus comprises temperature and humidity surrounding the apparatus.

7. The apparatus of claim 6, further comprising a calculation unit for calculating absolute humidity based on the temperature and the humidity, wherein the control unit compares the calculated absolute humidity with a preset absolute humidity, and selects one of the first and second supplying methods according to a result of comparing.

8. The apparatus of claim 1, further comprising a calculation unit for calculating varied first service life information and varied second service life information when the supplying of the charge voltage to the image bearing member is completed, wherein the control unit updates the first and second service life information stored in the storage unit with the varied first and second service life information.

9. The apparatus of claim 8, wherein the calculation unit uses the first and second service life information stored in the storage unit, a variation amount of the first service life information, a variation amount of the second service life information, a first correction coefficient used to convert the variation amount of the first service life information, and a second correction coefficient used to convert the variation amount of the second service life information to calculate the varied first and second service life information.

10. A method of supplying a charge voltage to an image bearing member for an image forming apparatus, the method comprising:

measuring information about conditions surrounding the image forming apparatus;

selecting one of a first supplying method and a second supplying method to supply a charge voltage to the image bearing member according to the measured information;

determining the charge voltage corresponding to a service life information according to the selected method; and supplying the determined charge voltage to the image bearing member using the selected method, wherein the first supplying method and the second supplying method are different from each other in type of voltage supplied to the image bearing member.

11. The method of claim 10, further comprising storing a first service life information of the image bearing member according to the first supplying method, a second service life information of the image bearing member according to the second supplying method, a first charge voltage value corresponding to the first service life information, and a second charge voltage value corresponding to the second service life information in a storage unit of the apparatus.

12. The method of claim 10, wherein the first supplying method is a method of supplying a direct current (DC) voltage, and the second supplying method is a method of supplying a DC voltage obtained by combining alternating current (AC) voltages.

13. The method of claim 10, wherein the service life information comprises one of the number of rotations of the image bearing member, the number of pages output by the image bearing member, and a driving time of the image bearing member.

14. The method of claim 10, wherein the information about the conditions surrounding the apparatus comprises temperature and humidity surrounding the apparatus.

15. The method of claim 14, further comprising calculating absolute humidity based on the temperature and the humidity, wherein the selecting of one of the first and second supplying methods includes comparing the calculated absolute humidity with a preset absolute humidity, and selecting one of the first and second supplying methods according to a result of comparing.

16. The method of claim 11, further comprising calculating varied first service life information and varied second service life information when the supplying of the charge voltage to the image bearing member is completed, and updating the first and second service life information stored in the storage unit with the varied first and second service life information.

17. The method of claim 16, wherein the calculating of the varied first and second service life information comprises using the first and second service life information stored in the storage unit, a variation amount of the first service life information, a variation amount of the second service life information, a first correction coefficient used to convert the variation amount of the first service life information, and a second correction coefficient used to convert the variation amount of the second service life information to calculate the varied first and second service life information.

18. A method of supplying a charge voltage to an image bearing member for an image forming apparatus, the method comprising:

measuring information about conditions surrounding an apparatus;

selecting one of a first supplying method and a second supplying method to supply a charge voltage to the image bearing member according to the measured information;

determining a charge voltage corresponding to a service life information according to the selected method; and supplying the determined charge voltage to the image bearing member using the selected method, wherein the first supplying method and the second supplying method are different from each other in type of voltage supplied to the image bearing member.

19. An image forming apparatus for supplying a charge voltage to an image bearing member, the apparatus comprising:

a sensor unit to measure information about conditions surrounding the image forming apparatus;

a control unit to select one of a first supplying method and a second supplying method to supply a charge voltage to the image bearing member according to the measured information and determine a charge voltage corresponding to a service life information according to the selected method; and a supplying unit to supply the determined charge voltage to the image bearing member using the selected method, wherein the first supplying method and the second supplying method are different from each other in type of voltage supplied to the image bearing member.

* * * * *